United States Patent [19]

Kawakami

[11] 3,952,624

[45] Apr. 27, 1976

[54] ELECTRONIC MUSICAL INSTRUMENT CAPABLE OF GENERATING TONE SIGNALS HAVING PITCH FREQUENCY, TONE COLOR AND VOLUME ENVELOPE VARIED WITH TIME

[75] Inventor: Genichi Kawakami, Hamakita, Japan

[73] Assignee: Nippon Gakki Seizo Kabushiki Kaisha, Shizuoka, Japan

[22] Filed: Nov. 1, 1974

[21] Appl. No.: 520,146

[30] Foreign Application Priority Data

Nov. 2, 1973 Japan ..... 48-123710

[52] U.S. Cl. ..... 84/1.26; 84/1.13; 84/1.19; 84/1.27; 84/DIG. 8; 84/DIG. 9; 84/DIG. 20

[51] Int. Cl.[2] ..... G10H 1/02; G10H 5/02

[58] Field of Search ..... 84/1.01, 1.09–1.13, 84/1.19–1.21, 1.24, 1.26, 1.27, DIG. 2, DIG. 8, DIG. 9, DIG. 20

[56] References Cited

UNITED STATES PATENTS

| | | | |
|---|---|---|---|
| 3,288,904 | 11/1966 | George | 84/1.01 |
| 3,538,804 | 11/1970 | George | 84/1.01 |
| 3,557,295 | 1/1971 | Adachi | 84/1.19 X |
| 3,570,357 | 3/1971 | Adachi | 84/1.26 |
| 3,571,481 | 3/1971 | Adachi | 84/1.13 |
| 3,614,288 | 10/1971 | Amano | 84/1.21 |
| 3,786,166 | 1/1974 | Mieda | 84/1.01 |
| 3,819,843 | 6/1974 | Okamoto | 84/1.1 |
| 3,828,108 | 8/1974 | Thompson | 84/1.01 |
| 3,828,110 | 8/1974 | Colin | 84/1.01 |
| 3,881,387 | 5/1975 | Kawakami | 84/1.24 |
| 3,886,834 | 6/1975 | Okamoto | 84/1.19 X |
| 3,886,836 | 6/1975 | Hiyoshi | 84/1.26 |
| 3,897,709 | 8/1975 | Hiyoshi et al. | 84/1.19 |
| 3,902,392 | 9/1975 | Nagahama | 84/1.01 |
| 3,902,396 | 9/1975 | Hiyoshi | 84/1.19 |
| R27,983 | 4/1974 | Stearns | 84/1.01 |

*Primary Examiner*—L. T. Hix
*Assistant Examiner*—Stanley J. Witkowski
*Attorney, Agent, or Firm*—Flynn & Frishauf

[57] ABSTRACT

An electronic musical instrument comprising a voltage controlled oscillator, a voltage controlled filter, a voltage controlled amplifier and envelope generators. An output envelope of the envelope generator has various parameters such as rise time and decay time or times. The envelope generator is of the voltage controlled type so that the parameters of the output envelope of the envelope generator are controllable in response to parameter controlling voltages from a parameter controlling voltage generator. In an attempt to enhance performance effects a switch circuit is provided, in accordance with the invention, to interchange between a rise time controlling voltage and a decay time controlling voltage which are both coupled from the parameter controlling voltage generator to the envelope generator.

3 Claims, 28 Drawing Figures

FIG. 1
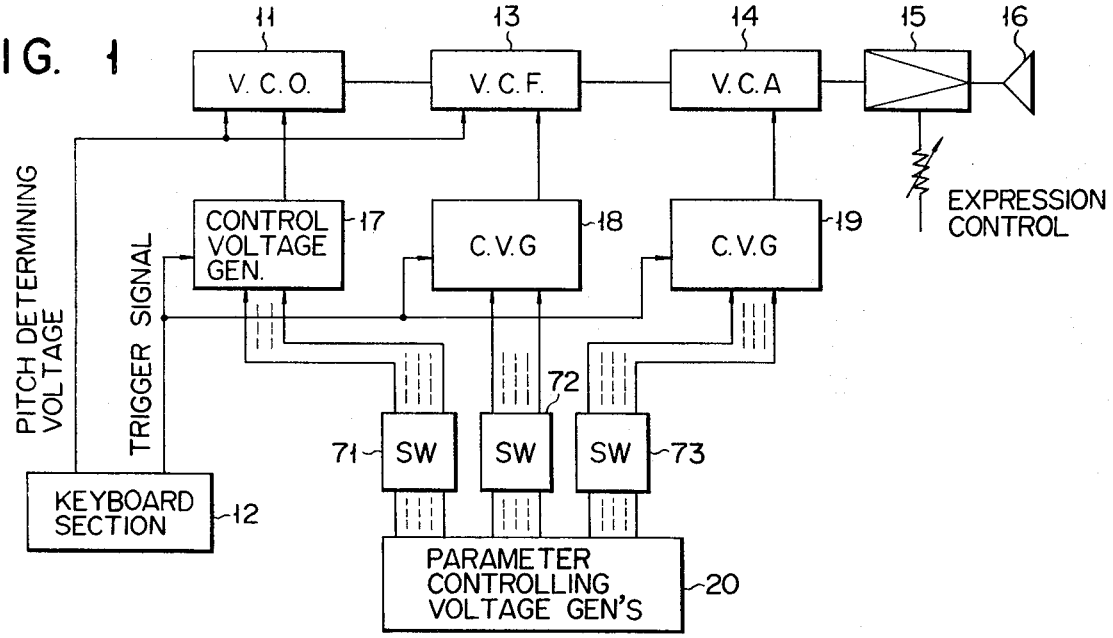
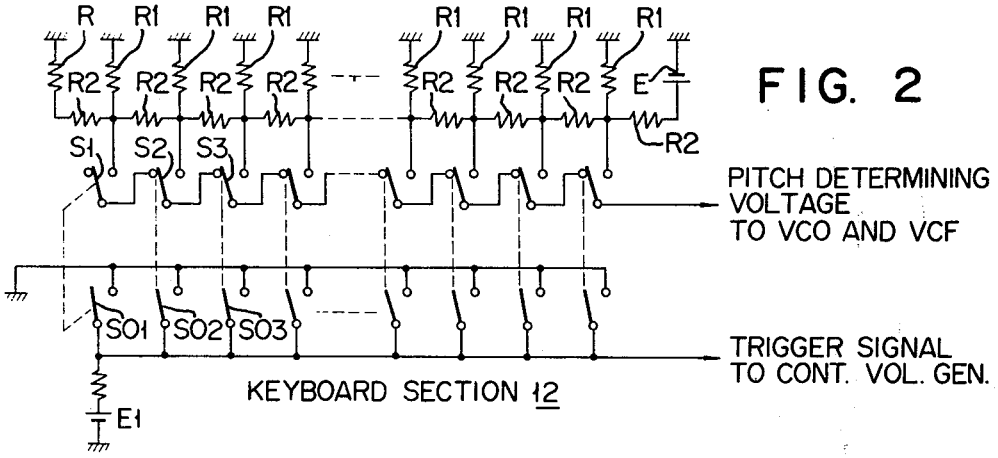
FIG. 2
FIG. 6
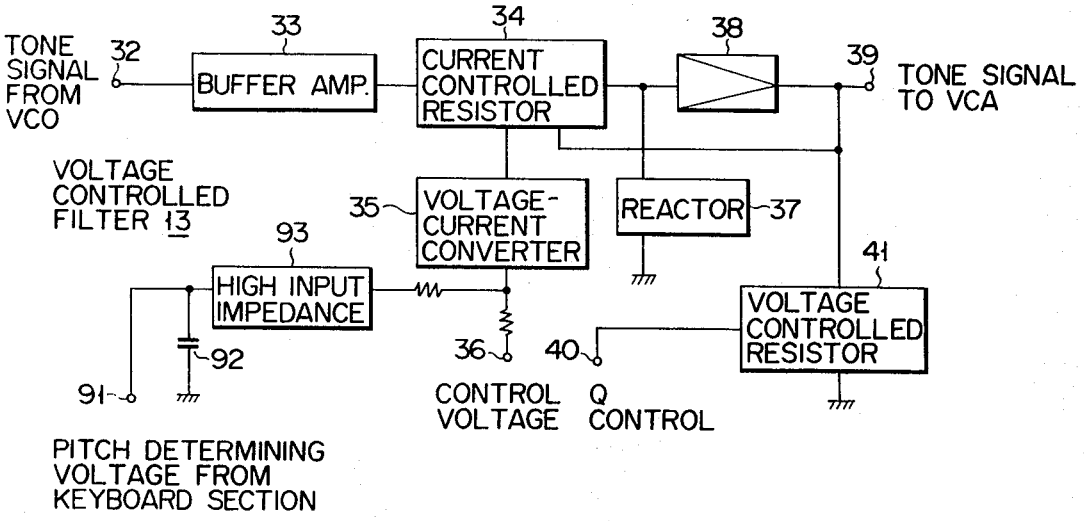

VCO 11

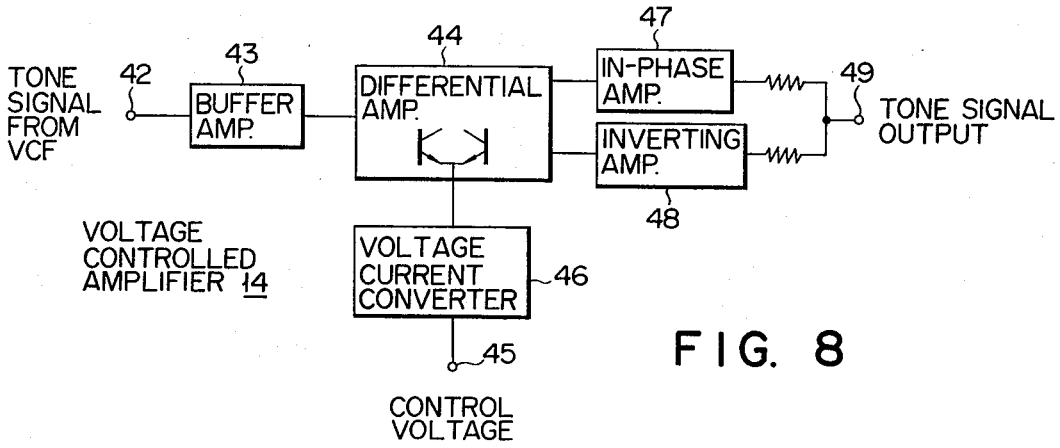
FIG. 8
FIG. 9
VCA 14
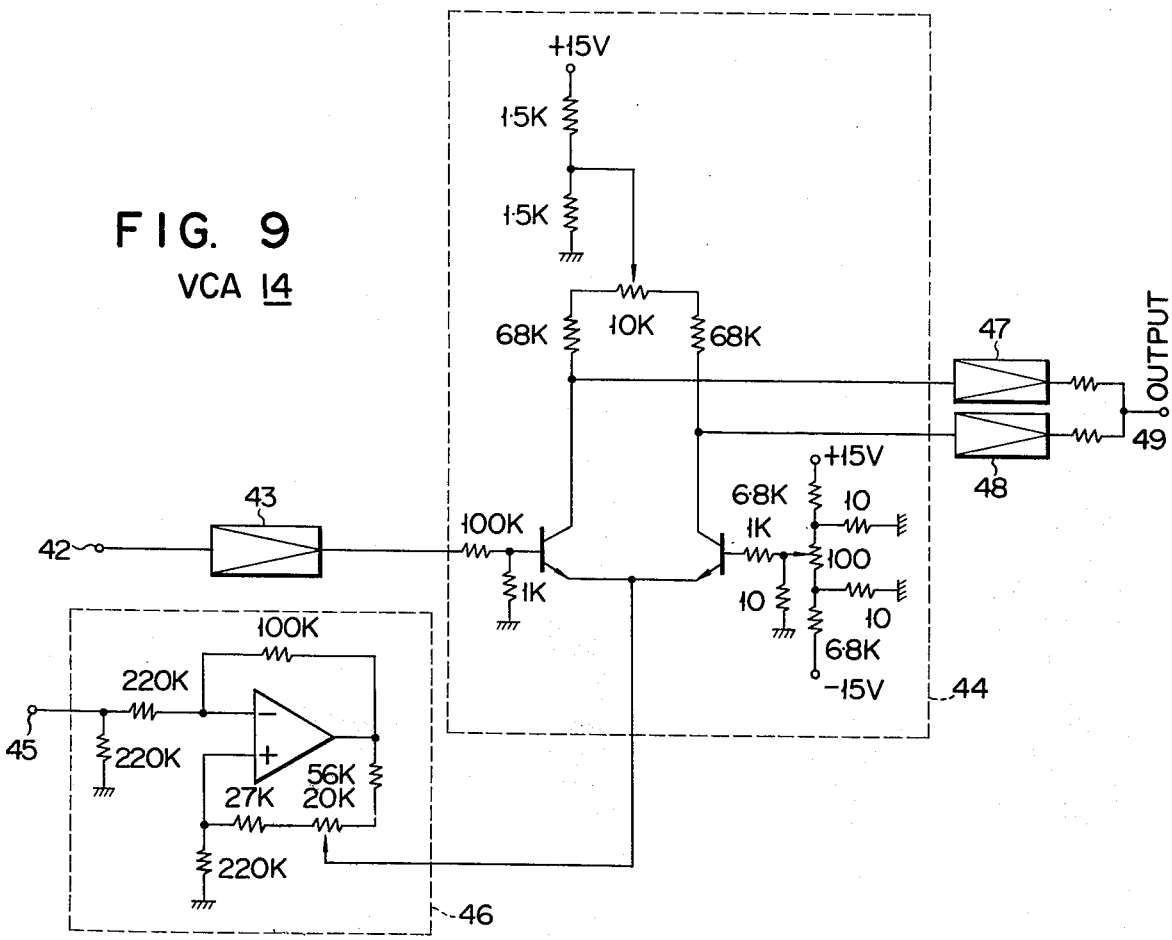

FIG. 14
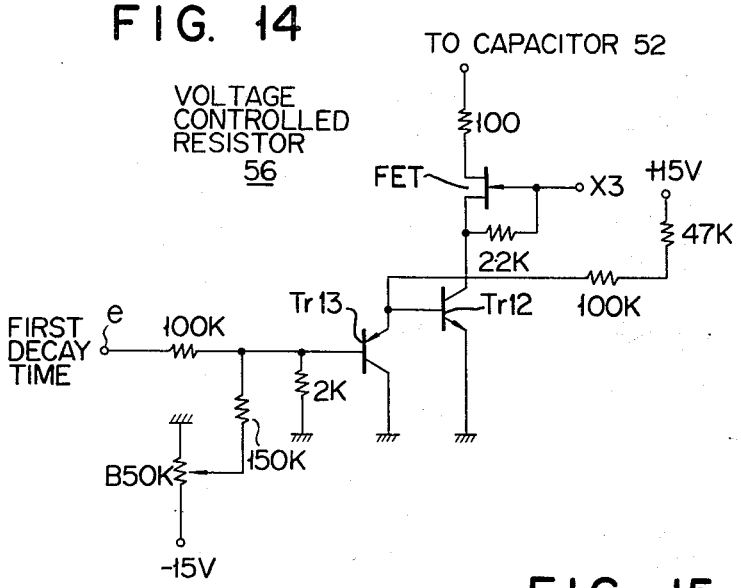
FIG. 15
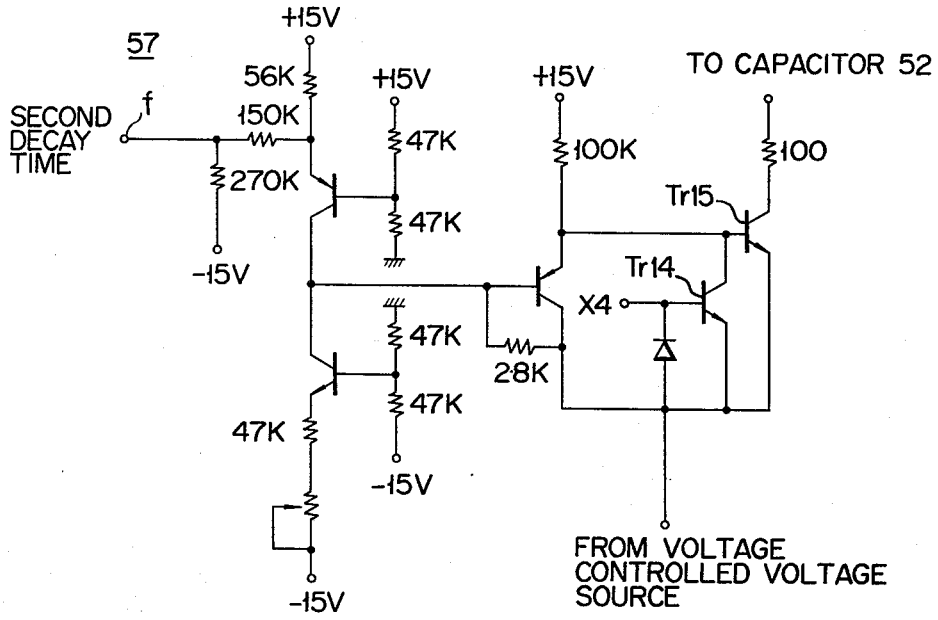
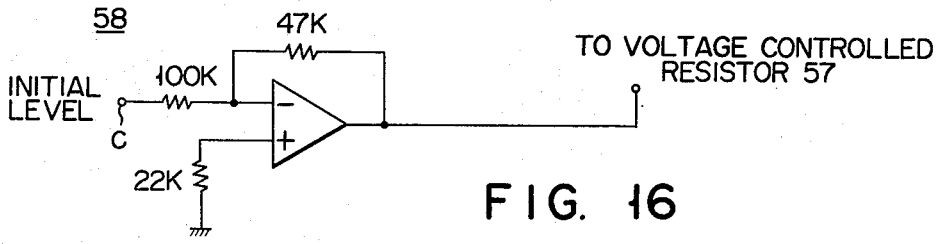
FIG. 16

FIG. 21
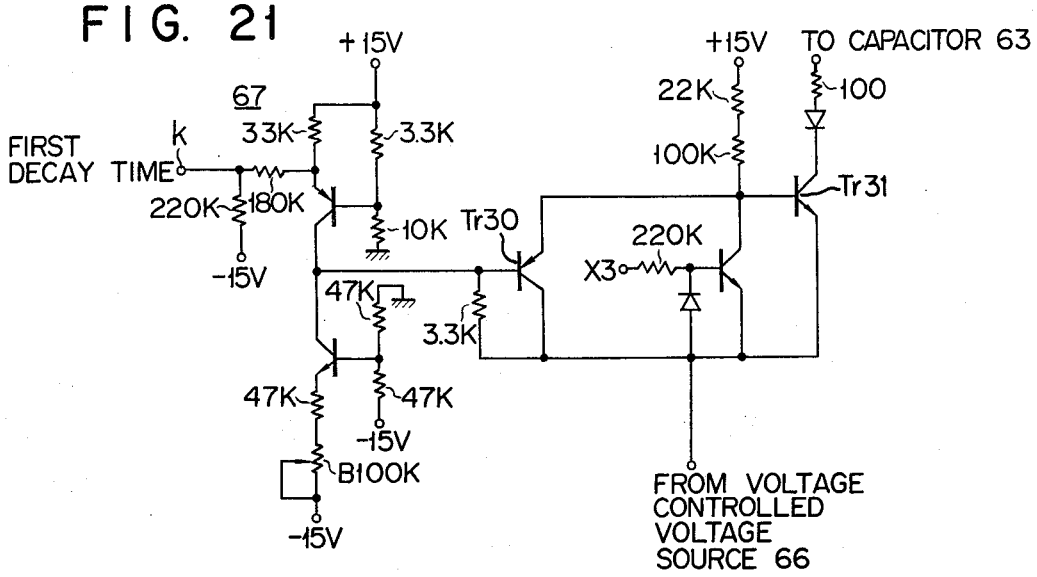
FIG. 22
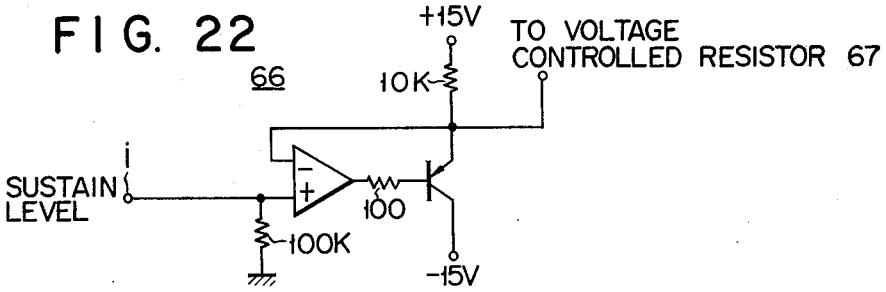
FIG. 23
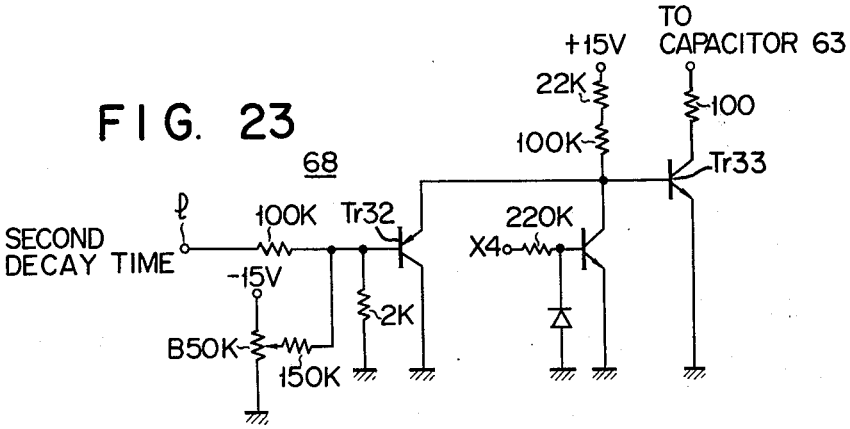
65 FIG. 24
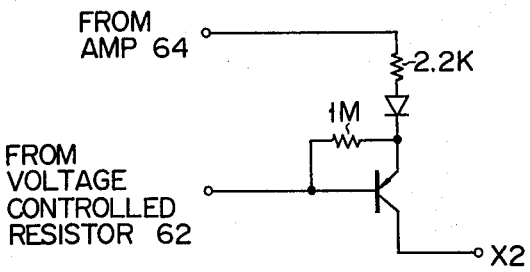

ELECTRONIC MUSICAL INSTRUMENT CAPABLE OF GENERATING TONE SIGNALS HAVING PITCH FREQUENCY, TONE COLOR AND VOLUME ENVELOPE VARIED WITH TIME

BACKGROUND OF THE INVENTION

This invention relates to an electronic musical instrument and more particularly to an electronic musical instrument of the keyboard type having a voltage controlled tone signal generating means.

With a conventional electronic musical instrument, tone signals corresponding to a plurality of keys are obtained by tone generators having master oscillators and frequency dividers for sequentially frequency-dividing the outputs of the oscillators. The tone signals are supplied selectively to tone coloring filters through key operation, thereby forming a tone color. With such an electronic musical instrument, therefore, the tone signal derived from the tone generators by key operation has the same pitch frequency during the key operation i.e. its tone pitch is not varied from the rise to the decay of the tone signal. The tone color imparted by the tone coloring filters during the key operation is all of the same nature. For this reason the musical sounds so obtained are inevitably monotonous.

SUMMARY OF THE INVENTION

It is accordingly the object of this invention to provide a keyboard type electronic musical instrument capable of causing the tone pitch and tone color of the tone signal obtained by key operation on a keyboard to be varied or modulated with time during the key depression and key release times.

According to one embodiment of this invention there are provided a single voltage controlled oscillator and a first control voltage generator for controlling the oscillation frequency of the voltage controlled oscillator. To the voltage controlled oscillator there are supplied a pitch determining voltage corresponding to any one of keys operated on a keyboard and a control voltage or envelope formed by the first control voltage generator in response to a trigger signal indicative of the operation of the key, the amplitude of the control voltage being varied with time during key depression and key release times. For this reason, the pitch frequency of that tone signal corresponding to the note of the operated key which is formed by the voltage controlled oscillator is transiently modulated. The output tone signal from the voltage controlled oscillator is supplied to a voltage controlled filter where a tone color is imparted to the tone signal. The voltage controlled filter has its cutoff frequency transiently controlled during the key depression and key release times by a control voltage from a second control voltage generator the amplitude of which is varied with time, and consequently an output from the filter undergoes a tone color modulation. The output tone signal of the voltage controlled filter is fed to a voltage controlled amplifier. The voltage controlled amplifier has its gain controlled by a control voltage from a third control voltage generator the amplitude of which is varied with time during the key depression and key release times, and consequently an envelope according to the control voltage waveform is imparted to the output of the voltage controlled amplifier. The voltage controlled amplifier is normally in a cutoff condition and is operated upon receipt of the control voltage to allow the passage of a signal and therefore functions as a keyer. The first, second and third control voltage or envelope generators generate, in response to various parameter controlling voltages from a parameter controlling voltage generator, control voltages having desired parameters. The control voltage waveforms from the first and second control voltage generators have such parameters as an initial level, attack level, normal level, attack time or rise time i.e. time interval from the initial level to the attack level as involved during the key depression time, first decay time i.e. time interval from the attack level to the normal level, and a second decay time i.e. time interval from the normal level to the initial level as involved during the key release time; and these parameters are controlled by the parameter controlling voltage generator. The control voltage waveform of the third control voltage generator has such parameters as a cutoff level, sustain level, attack time or rise time i.e. time interval from the cutoff level to the attack level as involved during the key depression, first decay time i.e. time interval from the attack level to the sustain level, and second decay time i.e. time interval from the sustain level to the cutoff level as involved during the key release; and these parameters are controlled by the parameter controlling voltage generator.

According to the invention, switching means is provided between an envelope generator and a parameter controlling voltage generator to interchange a rise time controlling voltage and a decay time controlling voltage which are both coupled to the envelope generator from the parameter controlling voltage generator. The invention can increase the diversity of the performance effects.

BRIEF DESCRIPTION OF THE DRAWING

FIG. 1 is a block diagram of an electronic musical instrument according to one embodiment of this invention;

FIG. 2 is a circuit arrangement of a keyboard section of FIG. 1;

FIG. 6 is a block diagram showing one example of the voltage controlled filter of FIG. 1;

FIG. 8 is a block diagram showing one example of the voltage controlled amplifier of FIG. 1;

FIG. 9 is a circuit diagram of the voltage controlled amplifier of FIG. 8;

FIGS. 11 to 17 show circuit diagrams of various parts of FIG. 10;

FIGS. 20 to 25 show circuit diagrams of various parts of FIG. 19;

DETAILED DESCRIPTION OF THE PREFERRED EMBODIMENTS

Figure 3:
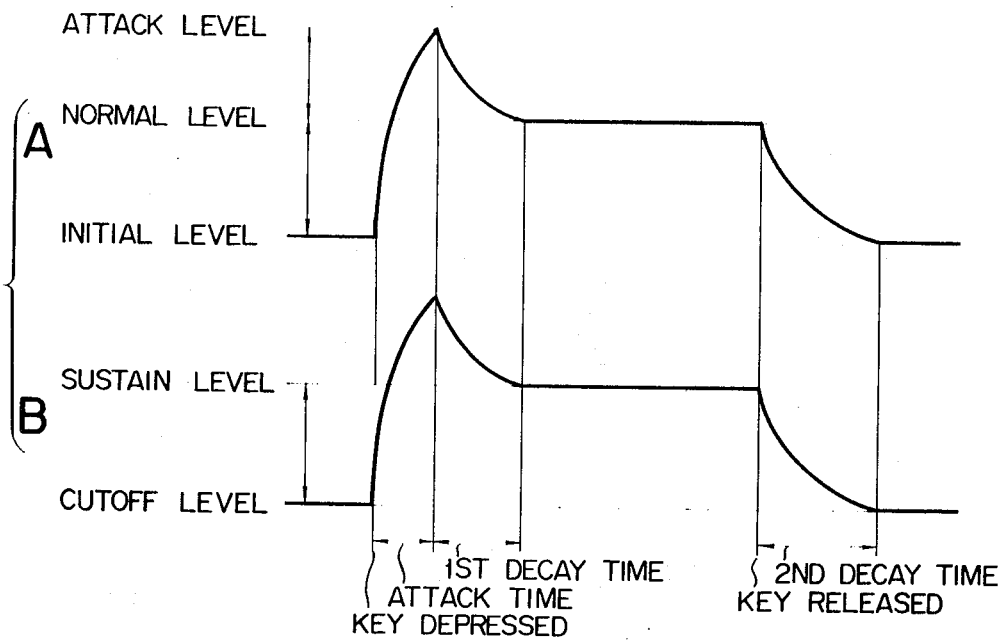
FIG. 3 shows the waveforms of control voltages applied to the voltage controlled oscillator, voltage controlled filter and voltage controlled amplifier of FIG. 1.

FIG. 1 shows one embodiment of this invention. In the drawing a reference numeral 11 shows a voltage controlled oscillator (hereinafter referred to as VCO). VCO 11 generates, in response to a pitch determining voltage signal obtained by key operation at a keyboard section 12, a tone signal having a pitch frequency which is a function of the note of an operated key. The tone signal from VCO 11 is coupled to a voltage controlled filter (hereinafter referred to as VCF), where a tone color is imparted to the tone signal, and then to a voltage controlled amplifier 14 (hereinafter referred to as VCA). The output of VCA 14 is fed through an output amplifier 15 to a loudspeaker 16. Control voltage generators 17 to 19 are provided to control the pitch, tone color and tone volume of the tone signal and coupled to VCO 11, VCF 13 and VCA 14, respectively. Control voltage generators 17 to 19 generate, in response to a trigger signal obtained by the key operation at the keyboard section 12, voltage envelope signals having various parameters set by a parameter controlling voltage generator 20, thereby controlling VCO 11, VCF 13 and VCA 14 respectively. VCO 11 is adapted to frequency-vary, according to an envelope waveform from the control voltage generator 17, a predetermined frequency signal corresponding to an operated key; VCF 13 is caused to have a cutoff frequency appropriate to a tone signal from the VCO 11 in response to the pitch determining voltage and has its cutoff frequency characteristic varied according to an envelope waveform from the control voltage generator 18; and VCA 14 has its amplification gain controlled according to an envelope waveform of the control voltage generator 19 to vary the envelope of an output tone signal therefrom.

Switch circuits 71, 72 and 73 as will be later described are provided between the control voltage generators 17, 18, 19 and the parameter controlling voltage generator 20 to interchange a rise time controlling voltage and a decay time controlling voltage which are both coupled to a respective control voltage generator.

FIG. 3 shows the graphical representation of control voltage waveforms obtained from the control voltage generators 17 to 19. In this graph, A shows the control voltage waveform applied to VCO 11 and VCF 13 and B shows the control voltage waveform applied to VCA 14. When the key is depressed, the voltage waveform A rises, during an attack time or rise time, from an initial level to an attack level and then decays, during a first decay time, from the attack level to a normal level. The normal level is continued until the key is released. After release of the key, the voltage waveform further decays, during a second decay time, from the normal level to the initial level.

When the voltage waveform A is fed to VCO 11, a tone signal is so controlled that its frequency abruptly varies during the key depression time from the initial level frequency somewhat lower than the normal level frequency to the attack level frequency somewhat higher than the normal level frequency. Thereafter, the tone signal frequency approaches, during the first decay time, to the normal level frequency which is a function of the pitch determining voltage from the keyboard section 12. After lapse of the first decay time, the tone signal frequency becomes equal to the normal level frequency. After release of the key, the tone signal frequency decays, during the second decay time, from the normal level frequency to the initial level frequency. That is, the tone signal frequency obtained from VCO 11 is modified according to the voltage waveform which is varied with time.

When the voltage waveform A is supplied to VCF 13, the cutoff frequency of the voltage controlled filter is controlled in accordance with the waveform and, consequently, the tone color of the tone signal is modified.

A voltage waveform B rises, upon depression of the key, from a cutoff level of a peak level. After lapse of the attack time, the voltage waveform is returned, during the first decay time, to a sustain level, and the sustain level is continued until the key is released. After release of the key, the voltage waveform decays, during the second decay time, from the sustain level to the cutoff level. When the voltage waveform B is supplied to VCA 14, such an envelope as is shown in the waveform B is imparted to the tone signal. When no voltage waveform B is applied to VCA 14, VCA 14 is in the cutoff state. It will be understood that VCA 14 is operated as a tone keyer.

FIG. 2 shows the arrangement of a typical keyboard section 12 from which a pitch determining voltage is supplied to VCO 11. The voltage of a power source E is divided by a voltage dividing circuit arrangement including resistors R, R1, R2, and the normally open fixed contacts of key switches S1, S2, S3, . . . are connected to the respective voltage dividing points. The operation of the voltage dividing circuit is conventional. The movable contacts of the respective key switches are connected to the normally closed fixed contacts of the adjacent key switches. When a plurality of keys are depressed at a time, a voltage of the voltage dividing point connected to the key switch actuated by the key corresponding to the highest note of actuated keys and having an amplitude which is a function of the note is fed to VCO 11 in the key switch arrangement shown. There are further provided key switches S01, S02, S03 . . . which are ganged with the key switches S01, S02, S03 . . . respectively. When the key is operated, a trigger signal whose voltage is lowered from a power source voltage E1 to zero volt is supplied to the control voltage generators 17 to 19. The control voltage generators 17 to 19 start the formation of control voltages upon receipt of the trigger signal.

Figure 4:
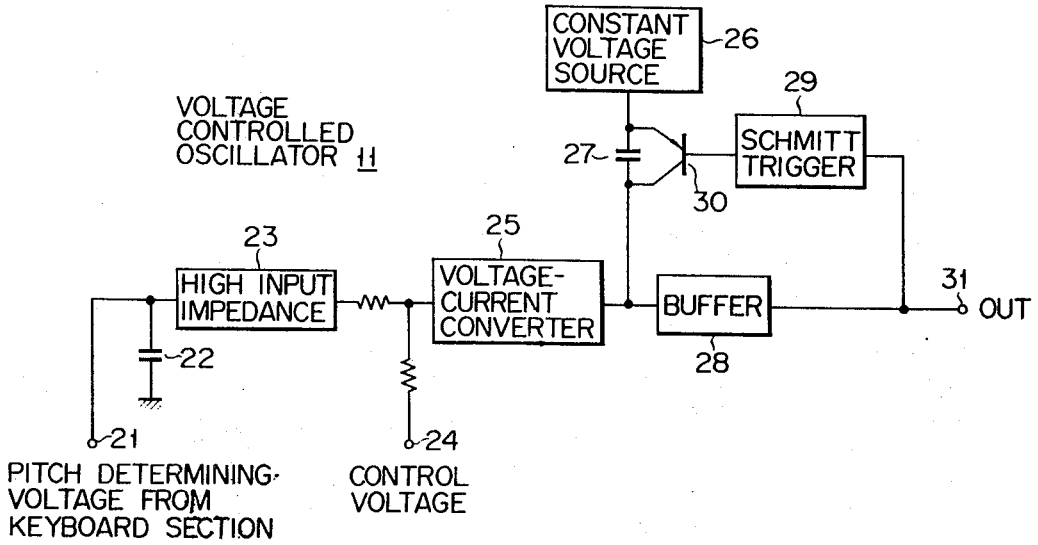
FIG. 4 is a block diagram showing one example of the voltage controlled oscillator of FIG. 1.
Figure 5:
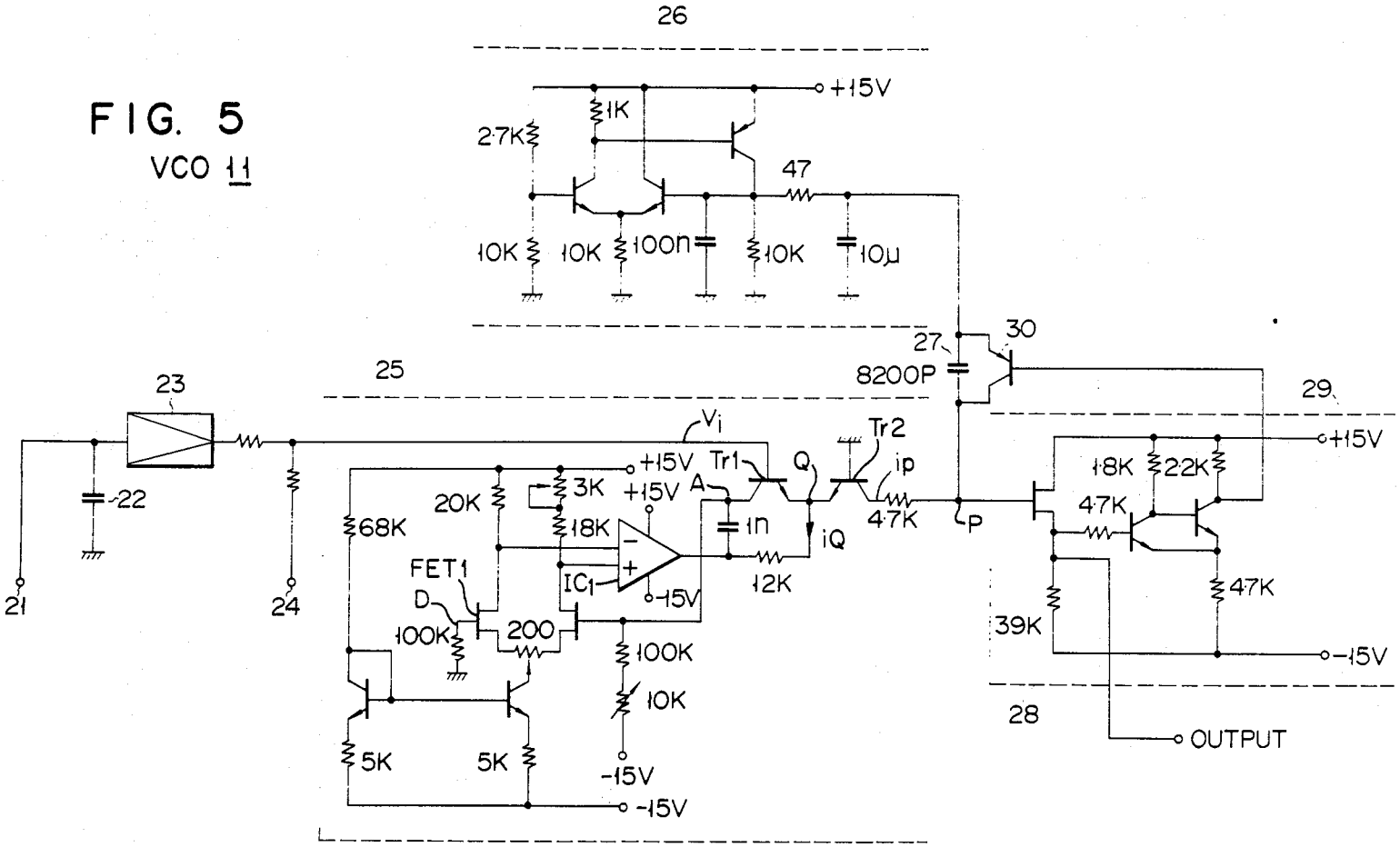
FIG. 5 is a circuit diagram of the voltage controlled oscillator of FIG. 4.

FIG. 4 shows a block diagram of VCO 11. A pitch determining voltage applied from the keyboard section 12 to an input terminal 21 is stored in a capacitor 22, and then after passage through a high input impedance device 23 added to a control voltage applied from the control voltage generator 17 through an input terminal 24. The added voltage is converted, at a voltage-current converter 25, into a current signal. An output current of the converter 25 charges a capacitor 27 connected to a constant voltage source 26. The voltage of the capacitor 27 is applied through a buffer 28 to schmitt trigger 29. When the voltage of the capacitor 27 reaches a predetermined voltage value, the schmitt trigger 29 is operative to render a transistor 30 conductive, causing the capacitor 27 to be discharged. An oscillation output of saw-tooth wave is delivered from an output terminal 31 by the repeated charge and discharge of the capacitor 27. The charging speed of the capacitor 27 is varied according to the magnitude of output current of the converter 25. Consequently, oscillation frequency is controlled by the pitch determining voltage from the keyboard section 12 and the controlled voltage from the control voltage generator 17. A more detailed circuit diagram of the VCO 11 is shown in FIG. 5, the operation of which should be apparent to those skilled in the art.

Figure 7:
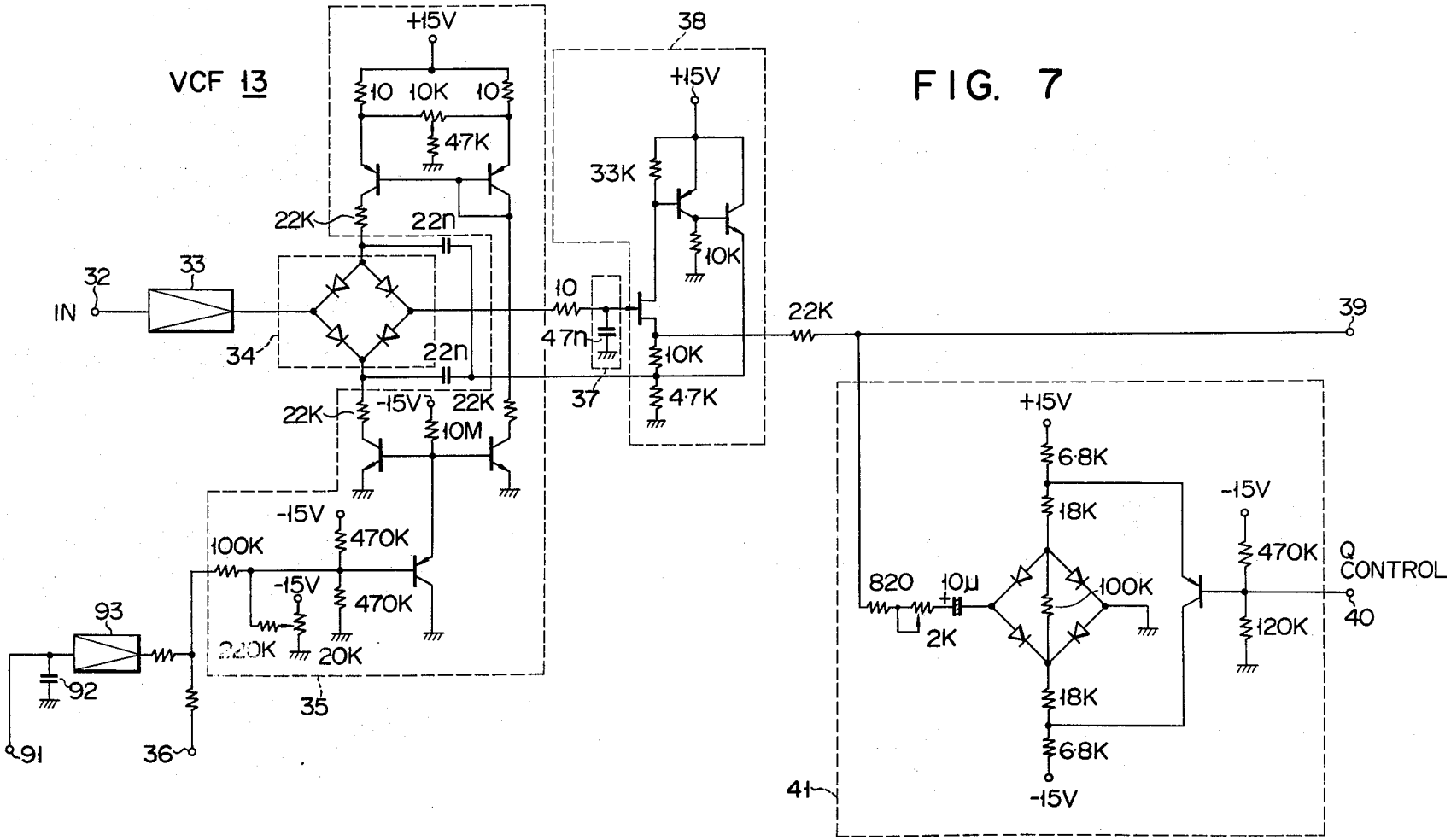
FIG. 7 is a circuit diagram of the voltage controlled filter of FIG. 6.

FIG. 6 shows a block diagram of VCF 13. A tone signal from an input terminal 32 is applied through a buffer amplifier 33 to a current controlled resistor 34. The current controlled resistor 34 is constituted by a diode etc. and controlled by an output current of a voltage-current converter 35 which receives a control voltage through a control terminal 36 together with a pitch determining voltage received at a terminal 91, charged in a capacitor 92 and passed through a high input impedance device 93. The resistor 34 determines, together with a reactance 37 (e.g. a capacitor), the cutoff frequency of the filter (e.g. an LPF). A tone color imparted tone signal is obtained, through an amplifier 38, from an output terminal 39. A Q control input supplied to a control terminal 40 controls a voltage-controlled resistor 41, thereby controlling the feedback amount of the amplifier 38 (constituting an active filter) and thus the Q factor of the filter. A more detailed circuit diagram of the VCF is shown in FIG. 7, the operation of which should be apparent to those skilled in the art.

FIG. 8 shows a block diagram of CVA 14. A tone signal from an input terminal 42 is supplied through a buffer amplifier 43 to a differential amplifier 44. The gain of the differential amplifier 44 is controlled by the output current of a voltage to current converter 46 which receives a control voltage from a control voltage generator 19 through a control terminal 45. The output signals of the differential amplifier 44 are supplied through an in-phase amplifier 47 and a phase inverting amplifier 48 to an output terminal 49. In both the outputs of the differential amplifier 44, the tone signal is included in an opposite phase relationship and a direct current component is included in an in-phase relationship. Consequently, only the tone signal is derived from the output terminal 49. A more detailed circuit diagram of the VCA 14 is shown in FIG. 9, the operation of which should be apparent to those skilled in the art.

Figure 10:
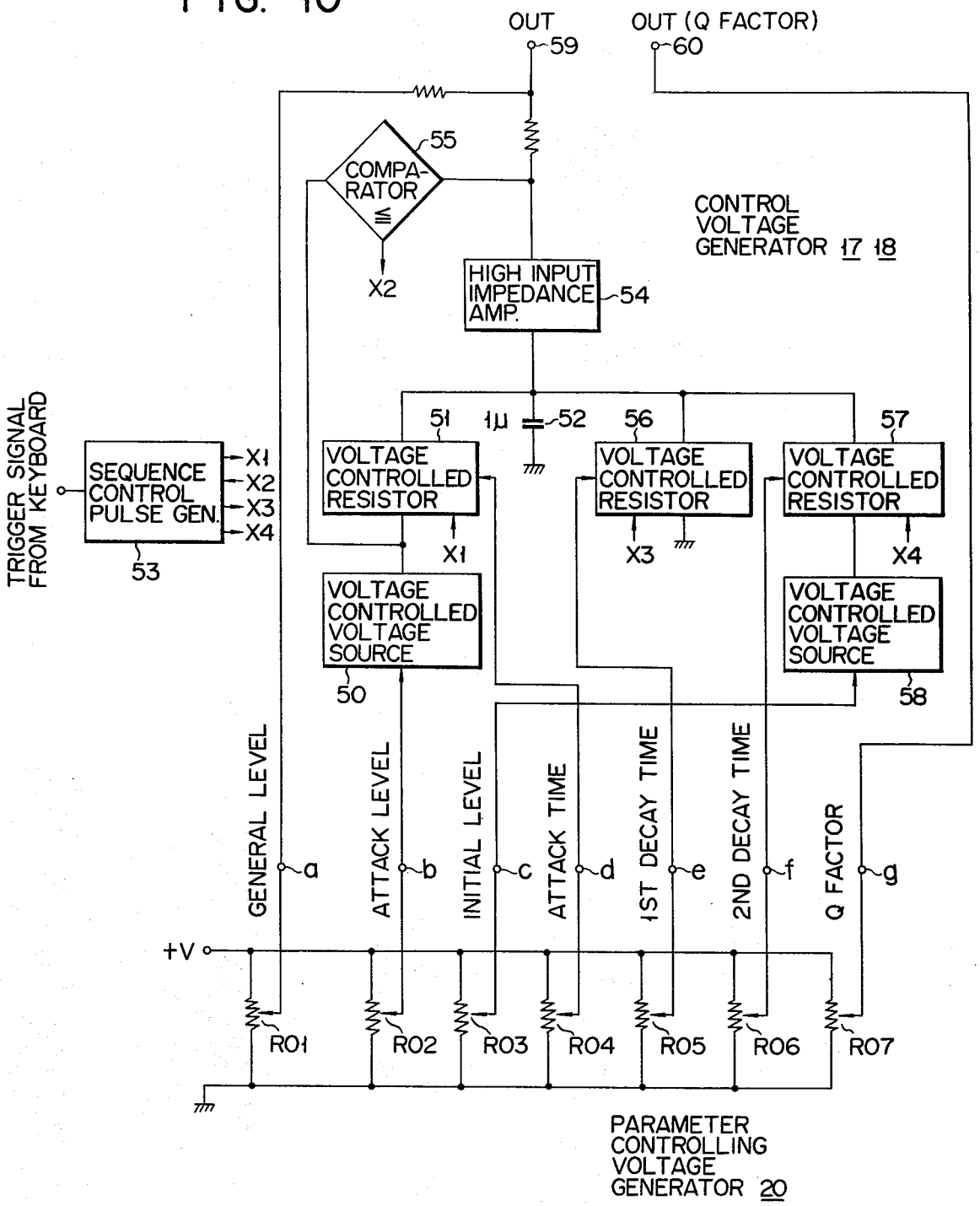
FIG. 10 is a block diagram of parameter controlling voltage generator, and control voltage generator for voltage controlled oscillator and voltage controlled filter.
Figure 11:
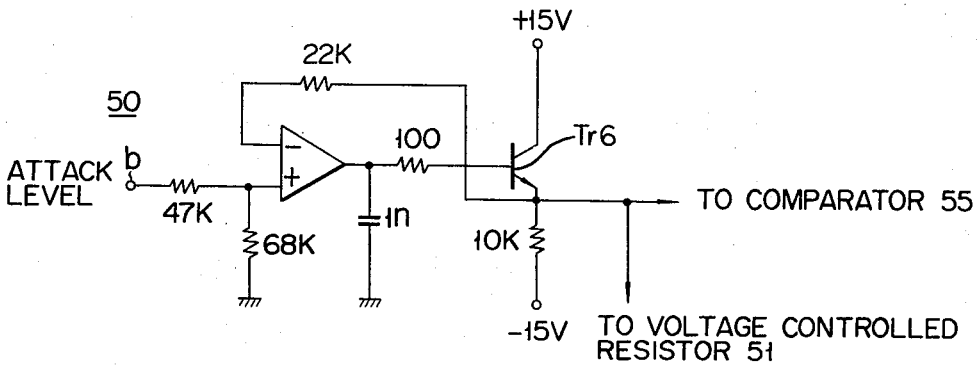
Figure 12:
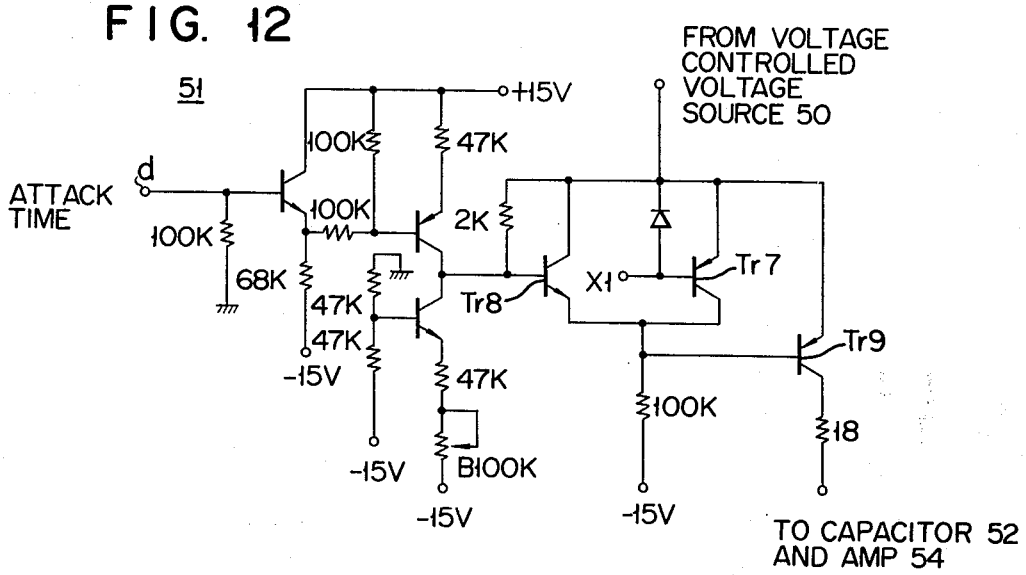

FIG. 10 shows a block diagram of the control voltage generators 17 and 18 and parameter controlling voltage generator 20. The pitch control voltage generator 17 and tone color control voltage generator 18 are identical in their arrangement, except that the latter has a Q factor control. The parameter controlling voltage generator 20 has potentiometers R01, R02, R03 . . . R07. R01 is adapted to couple a general level controlling voltage to a control terminal *a;* R02 an attack level controlling voltage to a control terminal *b;* R03 an initial level controlling voltage to a terminal *c;* R04 an attack time controlling voltage to a terminal *d;* R05 a first decay time controlling voltage to a terminal *e;* R06 a second decay time controlling voltage to a terminal *f;* and R07 a Q factor controlling voltage to a terminal *g*. A voltage controlled voltage source 50 generates, in response to the attack level controlling voltage, a voltage the amplitude thereof being a function of the amplitude of the attack level controlling voltage derived from the slider of potentiometer R02. The output voltage of the voltage source 50 is supplied through a voltage controlled resistor 51 to a capacitor 52. Upon receipt of a trigger signal from the keyboard section 12, a sequence control pulse generator 53 generates a control output X1 as shown in FIG. 18. The voltage controlled resistor 51 becomes operative to cause the capacitor 52 to be charged by the output voltage of the voltage source 50 in response to the control output X1 and its resistance determining a charging time constant is determined according to the amplitude of the attack time controlling voltage derived from the slider of potentiometer R04. The charging voltage of the capacitor 52 is derived through a high input impedance buffer amplifier 54 and compared with the output voltage of the voltage source 50 by a comparator 55. When the amplitude of voltage of the capacitor 52 reaches the amplitude of output voltage of the voltage source 50 i.e. the capacitor 52 is charged up to the attack level, the comparator 55 generates an output X2 as shown in FIG. 18. The sequence control pulse generator 53 then generates a control output X3 upon receipt of the output X2 as shown in FIG. 18. A voltage controlled resistor 56 becomes operative to create a discharging path of the capacitor 52 in response to the controlled output X3 and its resistance determining a discharging time constant i.e. the first decay time is determined according to the amplitude of the first decay time controlling voltage derived from the potentiometer R05. Upon release of the key at the keyboard section the sequence control pulse generator 53 generates a control output X4 as shown in FIG. 18. In response to the control output X4 the capacitor 52 is discharged, through a voltage controlled resistor 57, down to the initial level i.e. the level of output voltage of a voltage controlled voltage source 58 which is obtained in accordance with the amplitude of the initial level controlling voltage derived from the potentiometer R03. The discharging time constant i.e. the second decay time is dependent upon the resistance of the voltage controlled resistor 57 which is determined according to the amplitude of the second decay time controlling voltage derived from the potentiometer R06. The so varying voltage of the capacitor 52 and the general level of the potentiometer R01 are added together at an output terminal 59 to form a control voltage waveform as shown in FIG. 3A. The potentiometer R07 causes a Q factor control voltage to be generated at an output terminal 60. The Q factor control voltage is coupled to a control terminal 40 of VCF of FIG. 6. The sliders of potentiometers of parameter controlling voltage generator 20 may be provided on the control panel of an electronic musical instrument so as to be easily adjusted by a player. Detailed circuit diagrams of voltage controlled voltage source 50, voltage controlled resistor 51, comparator 55, voltage controlled resistor 56, voltage controlled resistor 57, voltage controlled voltage source 58 and sequence control pulse generator 53 are shown in FIGS. 11 to 17, respectively. The operation of the circuits of FIGS. 11–17 should be apparent to those skilled in the art.

Figure 19:
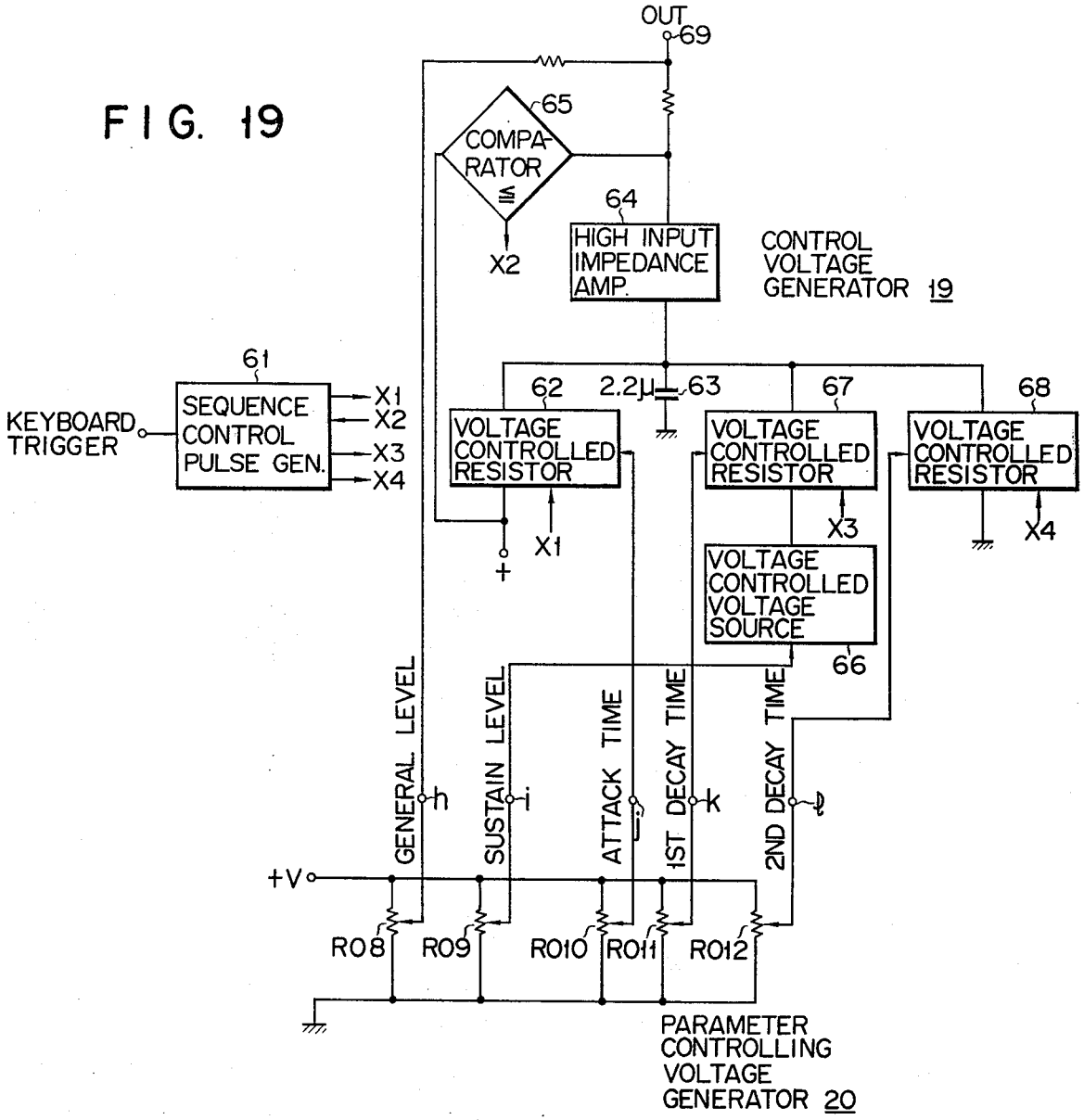
FIG. 19 is a block diagram of parameter controlling voltage generator and control voltage generator for voltage controlled amplifier.

FIG. 19 shows the block diagram of the envelope control voltage generator 19. The parameter controlling voltage generator 20 has potentiometers R08, R09, R010, R011 and R012 the sliders of which are coupled to control terminals *h, i, j, k* and *l*, respectively, which generate voltages for controlling parameters such as general level, sustain level, attack time, first decay time and second decay time of envelope control voltage as shown in FIG. 3B. Upon receipt of a trigger signal from the keyboard section 12, a sequence control pulse generator 61 generates a control output X1 as shown in FIG. 26. A voltage controlled resistor 62 is operated in response to the control output X1. As a result, a capacitor 63 is charged up to a peak level "+" with an attack time i.e. time constant dependent upon the resistance of the voltage controlled resistor 62 which is determined according to the amplitude of the attack time controlling voltage derived from the potentiometer R010. The voltage of the capacitor 63 is derived through a high input impedance amplifier 64. When the voltage of the capacitor 63 reaches the "+" level, a comparator 65 generates a control output X2 as shown in FIG. 26. The sequence control pulse generator 61 then generates a control output X3 upon receipt of the control output X2 as shown in FIG. 26. In response to the control output X3 the capacitor 63 is discharged, through a voltage controlled resistor 67 down to the sustain level i.e. the level of output voltage of a voltage controlled voltage source 66 which is determined according to the amplitude of the sustain level controlling voltage derived from the potentiometer R09. The resistance of the resistor 67, which determines a discharging time constant, is controlled by the amplitude of the first decay time controlling voltage derived from the potentiometer R011. Upon release of the key, a control output X4 is obtained as shown in FIG. 26 and the capacitor 63 is discharged through a voltage controlled resistor 68. The resistance of the voltage controlled resistor 68, which determines a discharge time constant, is controlled by the second decay time controlling voltage derived from the potentiometer R012. The so varying voltage of the capacitor 63 and the general level controlling voltage from the potentiometer R08 are added together at an output terminal 67 to form the control voltage waveform as shown in FIG. 3B. Detailed circuit diagrams of voltage controlled resistors 62 and 67, voltage controlled voltage source 66, voltage controlled resistor 68, comparator 65, and sequence control pulse generator 61 are shown in FIGS. 20 to 25, respectively. The operation of the circuits of FIGS. 11–17 should be apparent to those skilled in the art.

As described above, the parameters of control waves coupled to VCO 11, VCF 13 and VCA 14 are preset by a player using the sliders of potentiometers in the parameter controlling voltage generator 20. It will be noted that it is difficult for a player to adjust, during performance, the sliders of potentiometers to change the performance effect. In accordance with the invention, switch circuits 71, 72, 73 are provided between the parameter controlling voltage generator 20 and the control wave generators 17, 18, 19 thereby permitting an interchange between the attack time controlling voltage and the decay time controlling voltage or voltages which are both coupled to the control wave generator. Accordingly, a variety of performance effects can be provided because the player can easily change the control waveform during performance.

Figure 27:
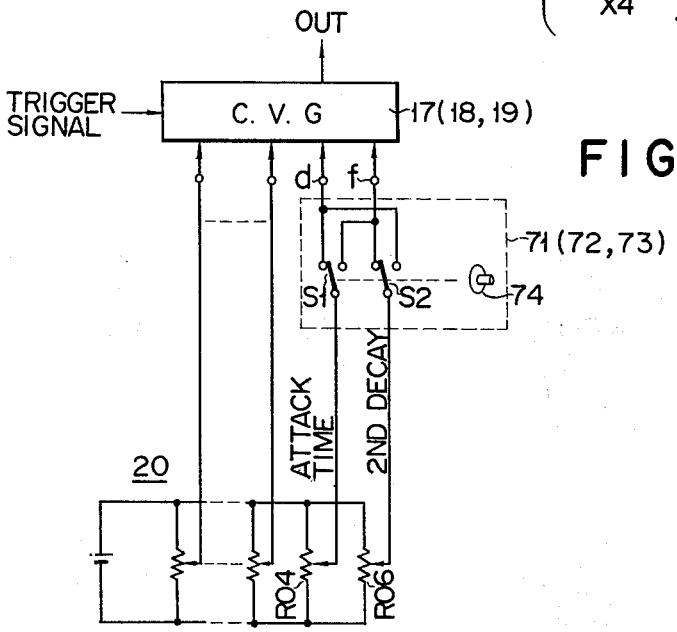
FIG. 27 shows electrical connection of the switch circuit of FIG. 1.

For example, each of the switch circuits 71, 72, 73 may comprises, as shown in FIG. 27, first and second double-throw switches S1 and S2 ganged with each other and operated by a knob 74 provided on the control panel of an electronic musical instrument. The movable contact of switch S1 is connected to the slider of potentiometer R04 for generating the attack time controlling voltage while the movable contact of second switch S2 is connected to the slider of potentiometer R06 for generating the second decay time controlling voltage.

A first fixed contact of the first switch S1 is connected to the control terminal d of control wave generator 17, while a second fixed contact is connected to the control terminal *f*. A first fixed contact of the second switch S2 is connected to the control terminal *f*, while a second fixed terminal is connected to the terminal d.

The operation of the arrangement in FIG. 27 will now be explained.

Figure 28:
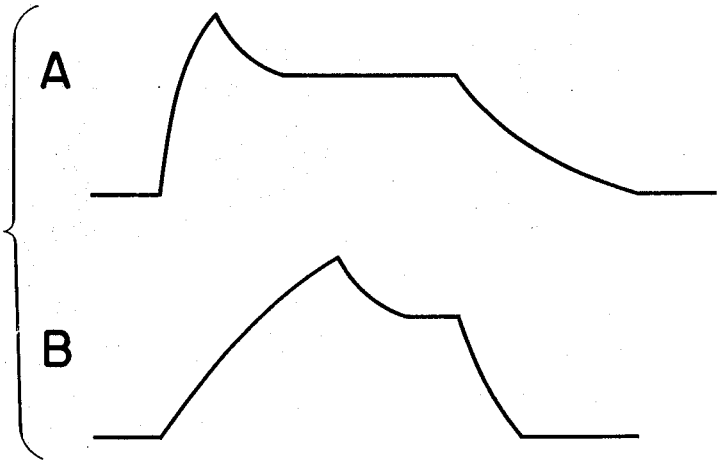
FIG. 28 shows control waveforms produced by the arrangement of FIG. 27.

In the condition of the switches S1 and S2 as shown, the attack time controlling voltage and the second decay time controlling voltage are respectively coupled to the attack time control terminal *d* and the second decay time control terminal f so that an envelope shown in FIG. 28A which is identical to that shown in FIG. 3 can be derived from the envelope generator 17. When the switches S1 and S2 are switched by the knob 74, then the attack time controlling voltage and the second decay time controlling voltage are respectively coupled to the control terminals f and d. As a result, an envelope can be obtained with the attack time and second decay time interchanged with each other as shown in FIG. 28B, thus providing a performance effect different from the performances effect as realized with the envelope shown in FIG. 28A.

In FIG. 27, there is shown an example in which the attack time and second decay time are interchanged with each other. It is possible, however, to effect an interchange between the attack time and the first decay time or between the first decay time and second decay time. The switch circuits 71, 72, 73 may have an arrangement similar to each other and the switches included in the switch circuits may be so constructed that they are switched concurrently by a single knob. If, however, the switching circuits are so arranged as to be controlled individually and independently with respect to each other, a greater diversity of performance effects can be obtained with the attendant advantage.

A more detailed discussion of selected important figures is discussed below.

A. FIG. 5

FIG. 5 is a detailed circuit diagram of the VCO 11. The same numerals in the figure denote the same elements as in FIG. 4. In the voltage-current converter 25, drive voltage signal Vi added with the voltage signals from the input terminals 21 and 24 is supplied to the base of a transistor Tr1. The emitter of the transistor Tr1 is connected to the emitter of another transistor Tr2 whose base is grounded, so that an output current signal ip may be taken from the collector of the transistor Tr2. A differential amplifier IC1 is set so as to make the potential at point A of the collector circuit of the transistor Tr1 equal to the potential at point D, the gate of a transistor FET1. Then current *i*Q is made to flow between the emitter connecting point Q of the transistors Tr1 and Tr2 and the differential amplifier IC1.

B. FIG. 11

The figure shows a voltage controlled voltage source 50 for determining the attack level. In response to an attack level designating signal supplied to the terminal b, a voltage signal corresponding to the attack level is obtained from the emitter circuit of a transistor Tr6. The attack level designating signal is further supplied to a voltage controlled resistor 51 (FIG. 12) for determining the attack time. A signal X1 is supplied to the base of a transistor Tr7 in the circuit 51, which is rendered non-conductive upon depression of a key. At this time the emitter of another transistor Tr8 assumes a potential corresponding to the attack time signal from the terminal *d*, thereby to control the base of a transistor Tr9. Consequently, the current from the voltage source 50 is controlled by the transistor Tr9 in accordance with the attack time and then charges a memory capacitor 52. Namely, the capacitor 52 is charged to the preset potential of the voltage controlled voltage source 50 during an attack time.

C. FIGS. 13–17

Figure 17:
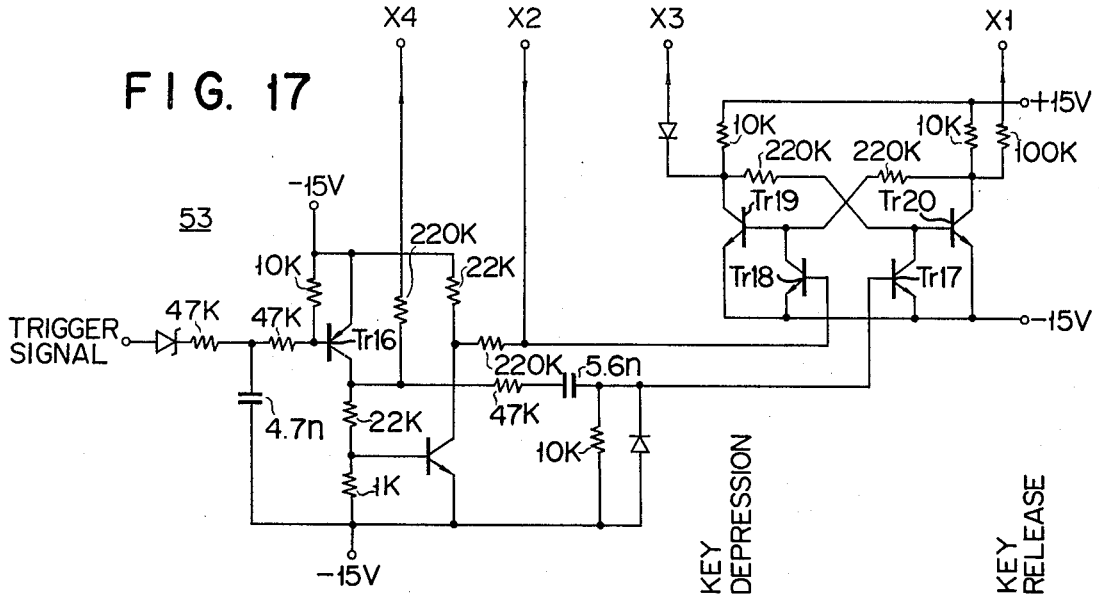
Figure 18:
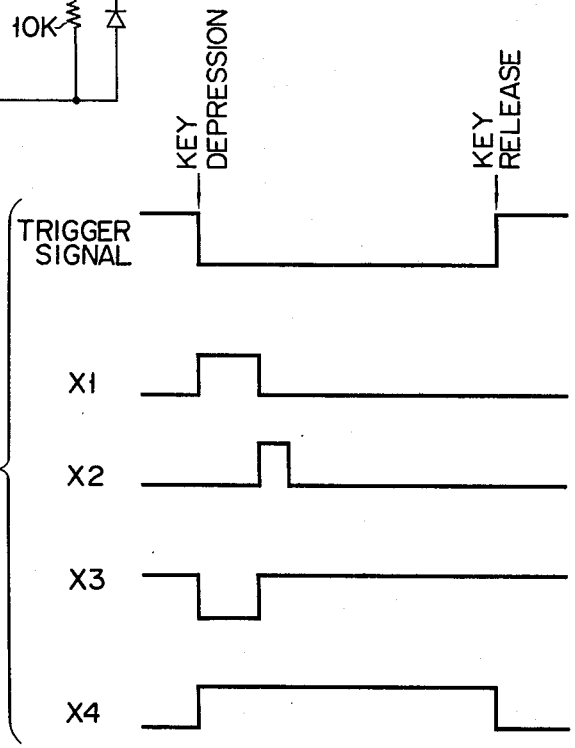
FIG. 18 shows various waveforms of sequence control pulses associated with the circuitry of FIG. 10.

FIG. 17 is a detailed circuit diagram of a sequence control pulse generator 53. When a trigger signal is supplied to the trigger signal terminal upon depression of a key, a transistor Tr16 begins operating, and its collector output renders a transistor Tr17 conductive. As a result, a transistor Tr19 becomes operative, and a transistor Tr20 inoperative. Consequently, signal X1 rises upon depression of the key.

Figure 13:
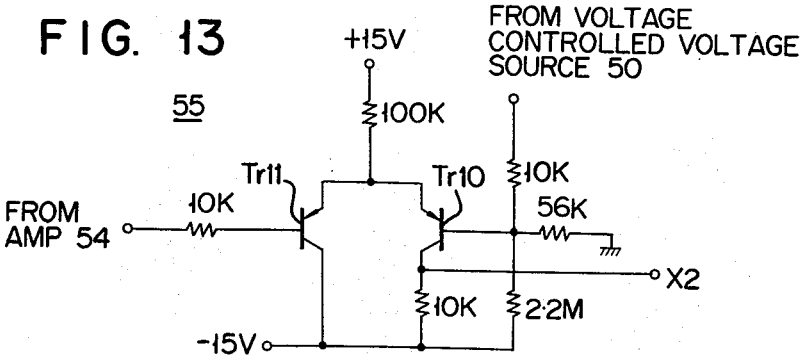

FIG. 13 shows a comparator 55, which receives the attack level signal from the voltage controlled voltage source 50 and the output voltage of the capacitor 52 through a high input impedance buffer amplifier 54. The signal and the voltage are compared by a transistor Tr10 and a transistor Tr11. If the output voltage of the capacitor 52 exceeds the attack level voltage, the transistor Tr10 is rendered conductive so as to allow a signal X2 to rise. When signal X2 rises, the transistor Tr18 of the pulse generator 53 (FIG. 17) is made conductive first, and then the transistor Tr20 instead of the transistor Tr19. As a result, signal X1 decays, and a signal X3 rises at the same time. That is, in the voltage controlled resistor 51 the transistor Tr7 becomes cut off, and the transistor Tr9 is rendered nonconductive, thereby interrupting the charging circuit for the capacitor 52.

Simultaneously, signal X3 enables a field effect transistor FET of a voltage controlled resistor 56 (FIG. 14) for determining the first decay tiem. Then the capacitor 52 is grounded through a transistor Tr12, thus forming a discharge circuit. In this case, the transistor Tr12 is controlled by a transistor Tr13 for taking out the first decay time designating signal in such a manner as to discharge the capacitor 52 to ground potential with time constant corresponding to the decay time. Here, the ground potential corresponds to the normal level of the control voltage, waveform of which is as illustrated in FIG. 3. After the elapse of the first decay time the voltage of the capacitor is maintained at this normal level (i.e. ground potential).

Further, as clear from FIG. 17, the transistor Tr16 remains conductive from the depression of a key until the release thereof. A signal X4 therefore rises upon depression of the key and falls upon the release of the key. This means that in the voltage controlled reistor 57 (FIG. 15) for determining the second decay time, a transistor Tr14 renders non-conductive a transistor Tr15 which constitutes the discharge circuit of the capacitor 52 during the depression of a key. Thus, upon release of the key, signal X4 rises, and the transistor Tr15 forms a discharge circuit for the capacitor 52 in accordance with the condition for determining the second decay time. As a result, the capacitor 52 is discharged until its voltage falls to the initial level determined by such a voltage controlled voltage source 58 as illustrated in FIG. 16.

D. FIGS. 20–26

Figure 25:
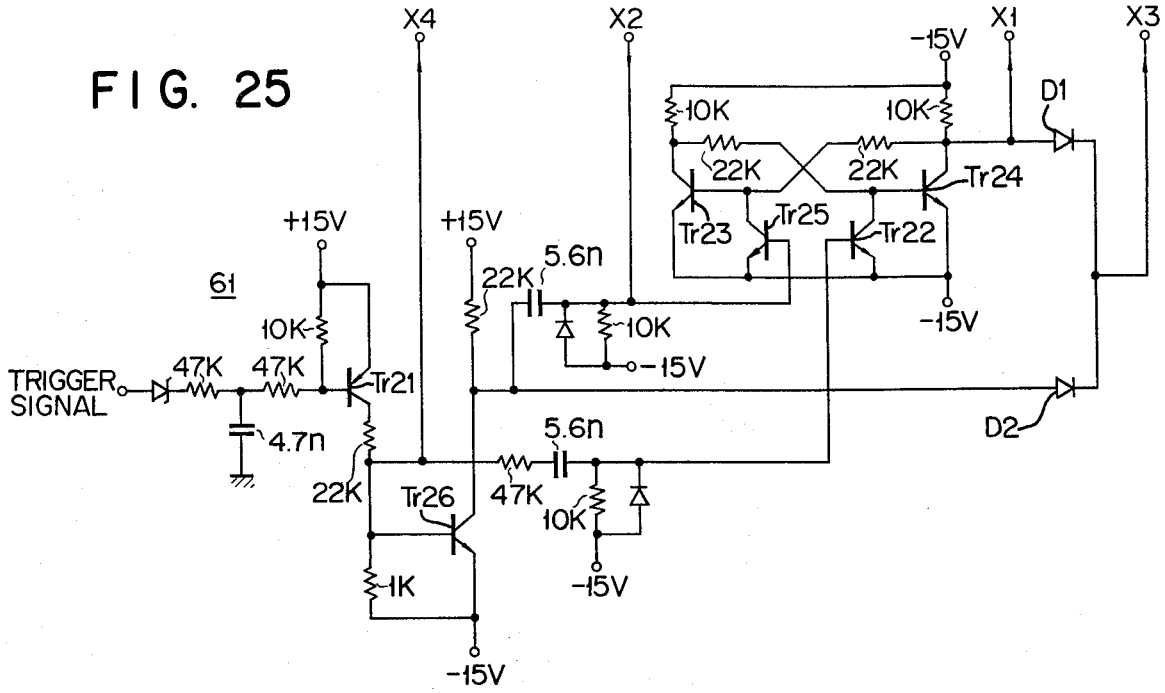
Figure 26:
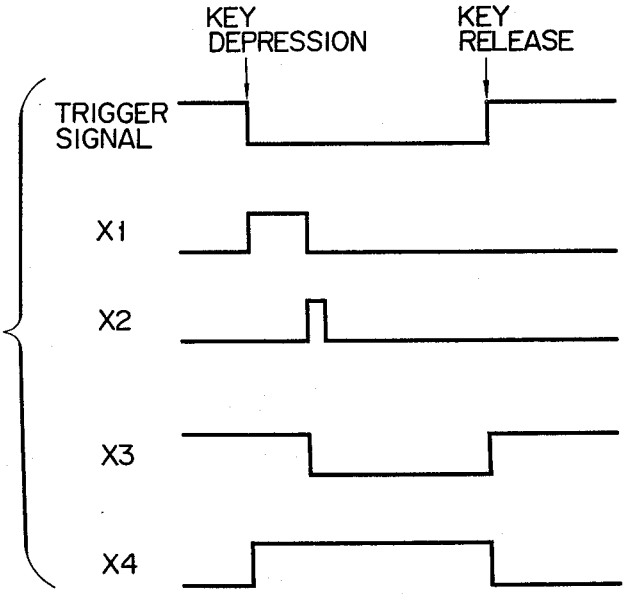
FIG. 26 shows various waveforms of sequence control pulses associated with the circuitry of FIG. 19.

FIG. 25 is a detailed circuit diagram of a sequence control pulse generator 61. A trsnsistor Tr21 becomes conductive when controlled by a trigger signal, thus obtaining such a signal X4 as shown in FIG. 26 from its collector circuit. In response to the rising of signal X4, a transistor Tr22 becomes conductive and brings transistors Tr23 and Tr24 into on- and off-state, respectively. When supplied with signal X2, a transistor Tr 25 is switched on to bring the transistors Tr23 and Tr 24 into off- and on-state, respectively, thereby obtaining such a signal X1 as shown in FIG. 26. Further, signal X1 and the collector output of a transistor Tr26 coupled to the transistor Tr21 are synthesized into a signal X3 by diodes D1 and D2. These signals X1–X4 determine the attack time, the first decay time and the second decay time.

Figure 20:
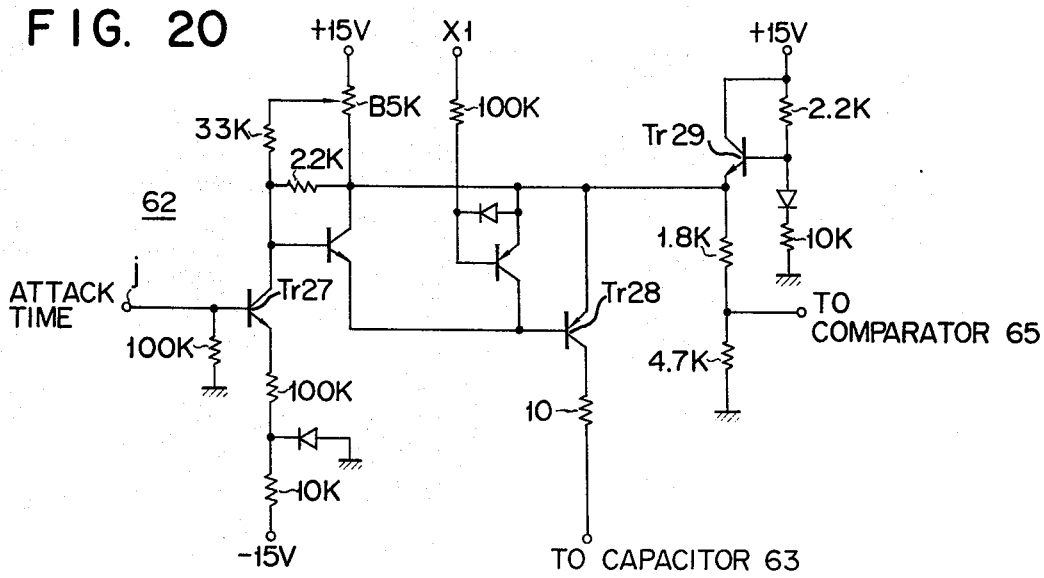

FIG. 20 is a detialed circuit diagram of a voltage controlled resistor 62 (FIG. 19) for determining the attack time, and FIG. 24 that of a comparator 65 (FIG. 19). In the circuit 62, a transistor Tr27 is controlled by the attack time designating signal from the terminal j, so that the impedance of a transistor Tr28, which is to form a charge circuit for the capacitor 63, may be set at the level according to the attack time signal while the circuit 62 is kept supplied with signal X1. Thus the capacitor 63 is charged with a time constant corresponding to the attack time signal. The comparator 65 compares the output voltage of the capacitor 63 with a voltage taken form a transistor Tr29. When the voltage of the capacitor 63 reaches a predetermined level, signal X2 rises.

FIGS. 21 and 22 are a detailed circuit diagram of a voltage controlled resistor 67 for determining a first decay time and a detailed circuit diagram of a voltage controlled voltage source 66 for determining a sustain level, respectively. In the circuit 67, a transistor Tr30 is controlled by the signal supplied through the terminal *k*, and a transistor Tr31 is controlled so long as the circuit 67 is supplied with signal X3 so as to form a discharge circuit for the capacitor 63. As a result, the capacitor 63 is discharged to the potential level determined by the voltage controlled voltage source 66, and sustain the level thereafter.

FIG. 23 shows a voltage controlled resistor 68 for determining the second decay time. A transistor Tr32 is controlled by the signal supplied through the terminal 1, and another transistor Tr33 is controlled so long as the circuit is supplied with signal X4. Consequently, the capacitor 63 is discharged through the transistor Tr33 to the ground level.

What is claimed is:

1. An electronic musical instrument of the keyboard type comprising:

a keyboard section including first means responsive to key operation on a keyboard for providing a pitch determining voltage the amplitude of which is a function of the note of an operated key on said keyboard, and second means responsive to key operation on said keyboard for providing a trigger signal indicative of key operation on said keyboard;

voltage controlled tone signal generating means including a voltage controlled oscillating means connected to receive said pitch determining voltage from said first means and for generating a tone signal the frequency of which is a function of the amplitude of said pitch determining voltage;

first envelope generating means connected to receive said trigger signal from said second means for generating a first envelope signal the amplitude of which varies with time, the envelope signal having voltage controlled parameters including at least one of rise time and decay time;

means coupling said first envelope signal of said first envelope generating means to said voltage controlled oscillating means for varying the oscillation frequency thereof as a function of said first envelope signal;

first parameter controlling voltage generating means for generating and coupling parameter controlling voltages to said envelope signal generating means, the parameter controlling voltages including a rise time controlling voltage and a decay time controlling voltage; and first switching means connected between said first envelope generating means and said first parameter controlling voltage generating means for interchanging between said rise time controlling voltage and said decay time controlling voltage, both being selectively coupled to said first envelope generating means.

2. An electronic musical instrument according to claim 1 further comprising a voltage controlled filter means coupled to the output of said voltage controlled oscillating means; second envelope generating means connected to receive said trigger signal for generating a second envelope signal the amplitude of which varies with time, said second envelope signal having voltage controlled parameters including at least one of rise time and decay time; means coupling said second envelope signal of said second envelope generating means to said voltage controlled filter means for varying the frequency characteristic thereof as a function of said second envelope signal; second parameter controlling voltage generating means for generating and coupling parameter controlling voltages to said second envelope generating means, the parameter controlling voltages including a rise time controlling voltage and a decay time controlling voltage; and second switching means connected between said second envelope generating means and said second parameter controlling voltage generating means for interchanging between said rise time controlling voltage and said decay time controlling voltage, both being selectively coupled to said second envelope generating means.

3. An electronic musical instrument according to claim 2 further comprising a voltage controlled amplifier means coupled to the output of said voltage controlled filter means; third envelope generating means connected to receive said trigger signal for generating a third envelope signal the amplitude of which varies with time, said third envelope signal having voltage controlled parameters including at least one of rise time and decay time; means coupling said third envelope signal of said third envelope generating means to said voltage controlled amplifier means for imparting to a generated tone signal an envelope which is a function of said third envelope signal; third parameter controlling voltage generating means for generating and coupling parameter controlling voltages to said third envelope generating means, the parameter controlling voltages including a rise time controlling voltage and a decay time controlling voltage; and third switching means connected between said third envelope generating means and said third parameter controlling voltage generating means for interchanging between said rise time controlling voltage and said decay time controlling voltage, both being selectively coupled to said third envelope generating means.

* * * * *